US006125346A

United States Patent [19]

Nishimura et al.

[11] Patent Number: 6,125,346

[45] Date of Patent: Sep. 26, 2000

[54] SPEECH SYNTHESIZING SYSTEM AND REDUNDANCY-REDUCED WAVEFORM DATABASE THEREFOR

[75] Inventors: Hirofumi Nishimura, Yokohama; Toshimitsu Minowa, Chigasaki; Yasuhiko Arai, Yokohama, all of Japan

[73] Assignee: Matsushita Electric Industrial Co., Ltd, Osaka, Japan

[21] Appl. No.: 08/985,899

[22] Filed: Dec. 5, 1997

[30] Foreign Application Priority Data

Dec. 10, 1996 [JP] Japan ..... 8-329845

[51] Int. Cl.[7] ..... G10L 19/00

[52] U.S. Cl. ..... 704/258; 704/267; 704/268; 704/207; 707/100

[58] Field of Search ..... 704/205, 207, 704/258, 268, 267; 707/100

[56] References Cited

U.S. PATENT DOCUMENTS

| | | | |
|---|---|---|---|
| 5,283,833 | 2/1994 | Church et al. | 704/252 |
| 5,454,062 | 9/1995 | La Rue | 704/254 |
| 5,715,368 | 2/1998 | Saito et al. | 704/268 |
| 5,745,650 | 4/1998 | Otsuka et al. | 704/260 |
| 5,751,907 | 5/1998 | Moebius et al. | 704/267 |
| 5,864,812 | 1/1999 | Kamai et al. | 704/268 |

FOREIGN PATENT DOCUMENTS

| | | |
|---|---|---|
| 0515709 | 12/1992 | European Pat. Off. . |
| 1-284898 | 11/1989 | Japan . |
| 6-250691 | 9/1994 | Japan . |
| 7-319497 | 12/1995 | Japan . |
| 8-234793 | 9/1996 | Japan . |

OTHER PUBLICATIONS

Arai Y et al: "An excitation synchronous pitch waveform extraction method and its application to the VCV–concatenation synthesis of Japanese spoken words" Proceedings ICSLP 96, Fourth International Conference on Spoken Language Processing (Cat. No. 96TH8206) Proceeding of Fourth International Conference on Spoken Language Processing, ICSLP '96, Philadelphia, PA, USA, Oct. 3–6, 1996, pp. 1437–1440, vol. 3, XP002087123 ISBN 0–7803–3555–4, 1996, New York, NY, USA, IEEE, USA.

Kawap H et al: "Development of a Text–to–Speech System for Japanese Based on Waveform Splicing" Proceedings of the International Conference on Acoustics, Speech, Signal Processing 1. Adelaide, Apr. 19–22, 1994, vol. 1, Apr. 19, 1994, pp. I–569–I–572 XP000529428 Institute of Electrical and Electronics Engineers.

Emerard F et al: "Base on donnees prosodiques pour la synthese de la parole" Journal D'Acoustique, Dec. 1988, France, vol. 1, No. 4, pp. 303–307, XP002080752.

Larreur D et al: "Linguistic and Prosodic Processing for a Text–to–Speech Synthesis System" Proceedings of the European Conference on Speech Communication and Technology (Eurospeech), Paris, Sep. 26–28, 1989, vol. 1, No. Conf. 1, Sep. 26, 1989, pp. 510–513, XP000209680.

Lopez–Gonzalo E et al: "Data–Driven Joint $F_0$ and Duration Modeling in Text To Speech Conversion for Spanish" Proceedings of the International Conference on Acoustics, Speech, Signal Processing (ICASSP), Speech Processing 1. Adelaide, Apr. 19–22, 1994, vol. 1, Apr. 19, 1994, pp. I–589–I–592, XP000529432 Institute of Electrical and Electronics Engineers.

*Primary Examiner*—David R. Hudspeth
*Assistant Examiner*—Abul K. Azad
*Attorney, Agent, or Firm*—Lowe Hauptman Gopstein Gilman & Berner

[57] ABSTRACT

A speech synthesizing system using a redundancy-reduced waveform database is disclosed. Each waveform of a sample set of voice segments necessary and sufficient for speech synthesis is divided into pitch waveforms, which are classified into groups of pitch waveforms closely similar to one another. One of the pitch waveforms of each group is selected as a representative of the group and is given a pitch waveform ID. The waveform database at least comprises a pitch waveform pointer table each record of which comprises a voice segment ID of each of the voice segments and pitch waveform IDs the pitch waveforms of which, when combined in the listed order, constitute a waveform identified by the voice segment ID and a pitch waveform table of pitch waveform IDs and corresponding pitch waveforms. This enables the waveform database size to be reduced. For each of pitch waveforms the database lacks, one of the pitch waveform IDs adjacent to the lacking pitch waveform ID in the pitch waveform pointer table is used without deforming the pitch waveform.

15 Claims, 15 Drawing Sheets

101
102
103
104
105
106
107
i
n
u
w
a
sh
COMMON
110
111
112
118
119
120
121
122
128
129

FIG. 4A

360

PITCH WAVEFORM POINTER TABLE

| VOICE SEGMENT ID | PITCH WAVEFORM ID | | | | | | | | | | | LABEL INFORMATION | | |
|---|---|---|---|---|---|---|---|---|---|---|---|---|---|---|
| | | | | | | | | | | | | PITCH COUNT IN LEADING VOWEL | PITCH COUNT IN CONSONANT | PITCH COUNT IN FOLLOWING VOWEL |
| : | | | | | | | | | | | | | | |
| inu | i100 | i100 | i101 | ··· | n100 | n101 | ··· | u200 | u200 | u201 | ··· | 20 | 10 | 20 |
| : | | | | | | | | | | | | | | |
| iwa | i100 | i200 | i300 | ··· | w30 | w10 | ··· | a500 | a400 | a300 | ··· | 23 | 15 | 30 |
| : | | | | | | | | | | | | | | |

FIG. 4B

365

PITCH WAVEFORM TABLE

| PITCH WAVEFORM ID | PITCH WAVEFORM DATA |
|---|---|

FIG. 10

PITCH WAVEFORM POINTER TABLE FOR PHONEME-CHAINED COMPONENT 'inu'

960inu

| ELAPSED TIME (ms) / PITCH BAND (Hz) | 2.4 | 4.5 | 6.4 | ··· | 25.4 | 27.1 | ··· | 32.2 | 34.1 | 36.3 | 38.9 | ··· | PITCH COUNT | | |
|---|---|---|---|---|---|---|---|---|---|---|---|---|---|---|---|
| | | | | | | | | | | | | | LEADING VOWEL | CONSONANT | FOLLOWING VOWEL |
| 350～400 | i130 | i120 | i121 | ··· | n130 | n121 | ··· | u230 | u220 | u221 | u221 | ··· | 20 | 10 | 20 |
| 300～350 | i120 | | i121 | ··· | | n121 | ··· | u220 | u220 | u221 | u221 | ··· | | | |
| 250～300 | i110 | i110 | i111 | ··· | n110 | n101 | ··· | u210 | | u221 | u221 | ··· | | | |
| 250～250 | i100 | i100 | i101 | ··· | n100 | n101 | ··· | u200 | u200 | u221 | u221 | ··· | | | |

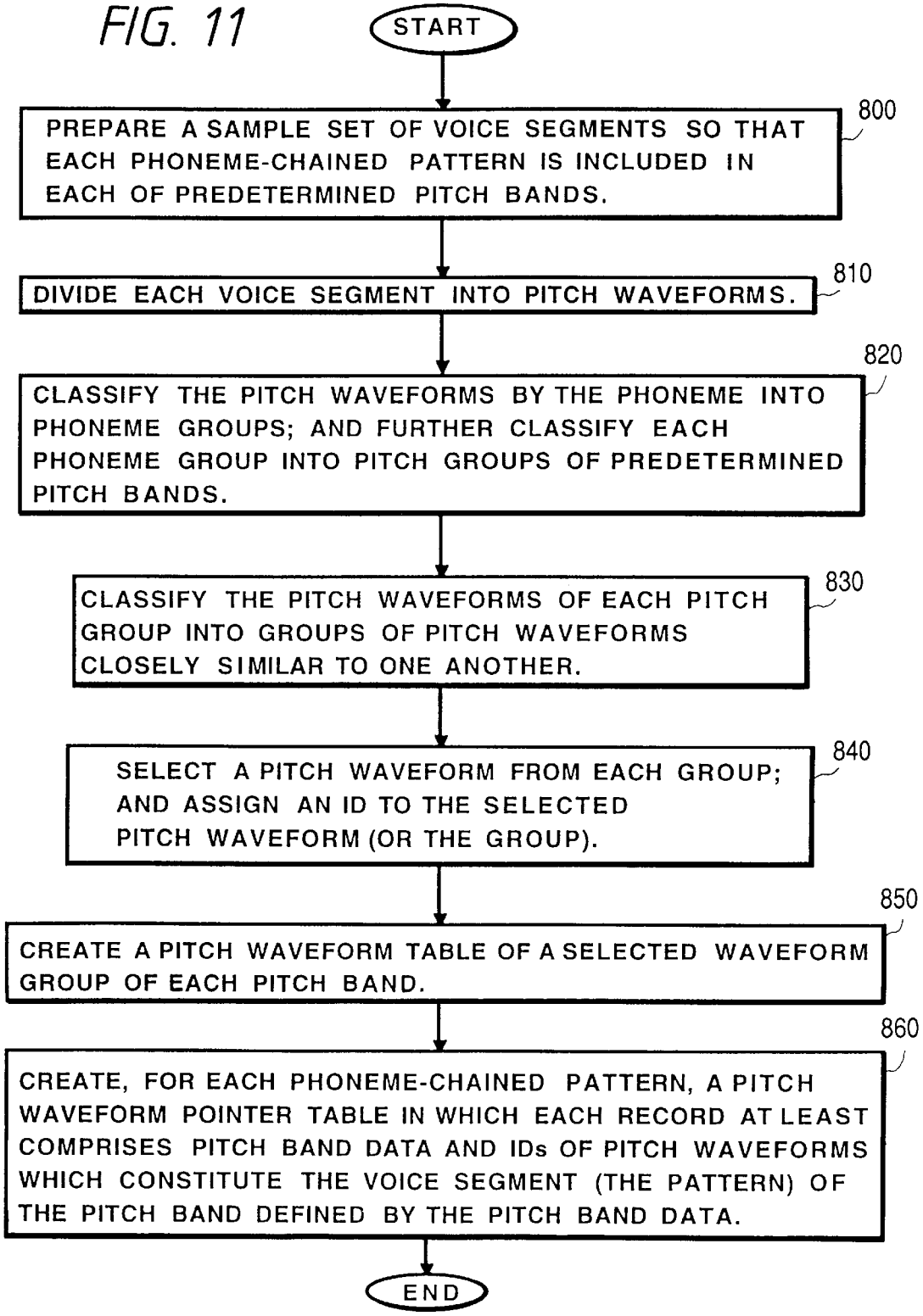
FIG. 11
START
PREPARE A SAMPLE SET OF VOICE SEGMENTS SO THAT EACH PHONEME-CHAINED PATTERN IS INCLUDED IN EACH OF PREDETERMINED PITCH BANDS.
800
DIVIDE EACH VOICE SEGMENT INTO PITCH WAVEFORMS.
810
CLASSIFY THE PITCH WAVEFORMS BY THE PHONEME INTO PHONEME GROUPS; AND FURTHER CLASSIFY EACH PHONEME GROUP INTO PITCH GROUPS OF PREDETERMINED PITCH BANDS.
820
CLASSIFY THE PITCH WAVEFORMS OF EACH PITCH GROUP INTO GROUPS OF PITCH WAVEFORMS CLOSELY SIMILAR TO ONE ANOTHER.
830
SELECT A PITCH WAVEFORM FROM EACH GROUP; AND ASSIGN AN ID TO THE SELECTED PITCH WAVEFORM (OR THE GROUP).
840
CREATE A PITCH WAVEFORM TABLE OF A SELECTED WAVEFORM GROUP OF EACH PITCH BAND.
850
CREATE, FOR EACH PHONEME-CHAINED PATTERN, A PITCH WAVEFORM POINTER TABLE IN WHICH EACH RECORD AT LEAST COMPRISES PITCH BAND DATA AND IDs OF PITCH WAVEFORMS WHICH CONSTITUTE THE VOICE SEGMENT (THE PATTERN) OF THE PITCH BAND DEFINED BY THE PITCH BAND DATA.
860
END

SPEECH SYNTHESIZING SYSTEM AND REDUNDANCY-REDUCED WAVEFORM DATABASE THEREFOR

BACKGROUND OF THE INVENTION

1. Field of the Invention

The present invention relates to a speech synthesizing system and method which provide a more natural synthesized speech using a relatively small waveform database.

2. Description of the Prior Art

In a conventional speech synthesizing system in a certain language, each of speeches is divided into voice segments (phoneme-chained components or synthesis units) which are shorter in length than words used in the language. A database of waveforms for a set of such voice segments necessary for speech synthesis in the language is formed and stored. In a synthesis process, a given text is divided into voice segments and waveforms which are associated with the divided voice segments by the waveform database are synthesized into a speech corresponding to the given text. One of such speech synthesis systems is disclosed in Japanese Patent Unexamined Publication No. Hei8-234793 (1996).

However, in a conventional system, a voice segment is to be stored as a different one in the database even if there exist in the database one or more voice segments the waveforms of which in the most part are the same as that of the voice segment if the voice segment differs from any of the voice segments which have been stored in the database, which makes the database redundant. If the voice segments in the database are limited in number in order to avoid the redundancy, any of the limited voice segments has to be deformed for each of lacking voice segments in a speech synthesis process, causing the quality of the synthesized speech to be degraded.

It is an object of the invention to provide a speech synthesizing system and method which permits a waveform database to be made smaller in size while providing a satisfactory speech synthesis quality by avoiding any speech segment deformation for a lacking speech segment in the waveform data base.

SUMMARY OF THE INVENTION

The foregoing object is achieved by a system in which each of the waveforms corresponding to typical voice segments (phoneme-chained components) in a language is further divided into pitch waveforms, which are classified into groups of pitch waveforms which closely resemble each other. One of the pitch waveforms of each group is selected as a representative of the group and is given a pitch waveform ID. A waveform database at least comprises a (pitch waveform pointer) table each record of which comprises a voice segment ID of each of the voice segments and pitch waveform IDs the pitch waveforms of which, when combined in the listed order, constitute a waveform identified by the voice segment ID and a (pitch waveform) table of pitch waveform IDs and corresponding pitch waveforms. This enables different but similar voice segments to share common pitch waveforms, causing the size of the waveform database to be reduced. For each of pitch waveforms the database lacks, a pitch waveform which is the most similar to the lacking pitch waveform is used, that is, one of the pitch waveform IDs adjacent to the lacking pitch waveform ID in the pitch waveform pointer table is used without deforming the pitch waveform.

BRIEF DESCRIPTION OF THE DRAWING

Further objects and advantages of the present invention will be apparent from the following description of the preferred embodiments of the invention as illustrated in the accompanying drawing, in which:

FIG. 4A is a diagram showing an exemplary pitch waveform pointer table formed in step 350 of FIG. 3;

FIG. 4B is a diagram showing an exemplary arrangement of each record of the pitch waveform table created in step 340 of FIG. 3;

FIG. 10 shows an exemplary structure of a pitch waveform pointer table, e.g., 306inu (for a phoneme-chained pattern 'inu') shown in FIG. 9;

FIG. 11 is a flow chart illustrating a procedure of forming the voiced sound waveform database 900 of FIG. 9;

Throughout the drawing, the same elements when shown in more than one figure are designated by the same reference numerals.

DETAILED DESCRIPTION OF THE PREFERRED EMBODIMENTS

Figure 1:
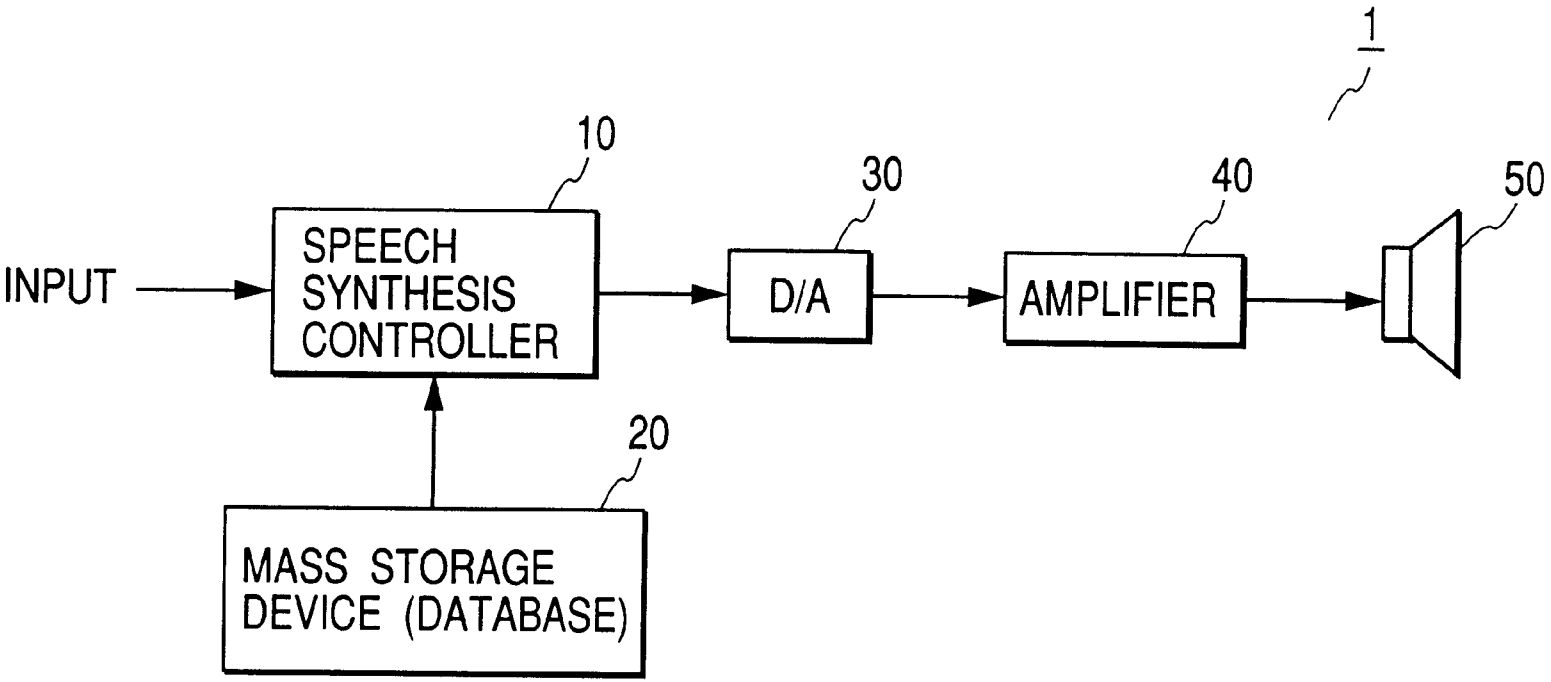
FIG. 1 is a schematic block diagram showing an exemplary speech synthesis system embodying the principles of the invention.

Speech synthesis system 1 of FIG. 1 comprises a speech synthesis controller 10 operating in accordance with the principle of the invention, a mass storage device 20 for storing a waveform database used in the operation of the controller 10, a digital to analog converter 30 for converting the synthesized digital speech signal into an analog speech signal, and a loudspeaker 50 for providing a synthesized speech output. The mass storage device 20 may be of any type with a sufficient storage capacity and may be, e.g., a hard disc, a CD-ROM (compact disc read only memory), etc. The speech synthesis controller 10 may be any suitable conventional computer which comprises a not-shown CPU (central processing unit) such as a commercially available microprocessor, a not-shown ROM (read only memory), a not-shown RAM (random access memory) and an interface circuit (not shown) as is well known in the art.

Though the waveform database according to the principle of the invention as described later is usually stored in the mass storage device 20 which is less expensive then IC memories, it may be embodied in the not-shown ROM of the controller 10. A program for use in the speech synthesis in accordance with the principles of the invention may be stored either in the not-shown ROM of the controller 10 or in the mass storage device 20.

Waveform Database

Figure 2:
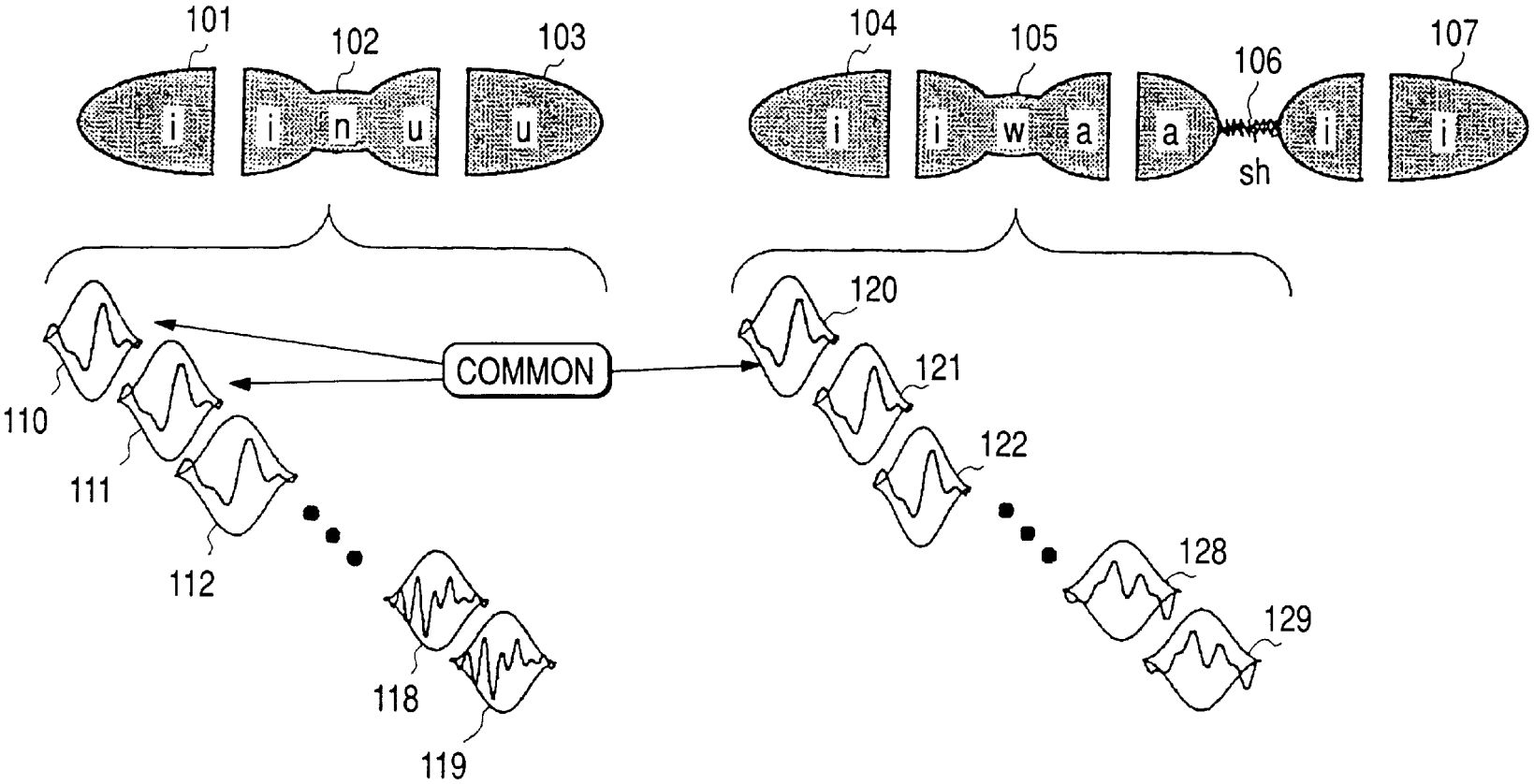
FIG. 2 is a diagram showing how, for example, Japanese words 'inu' and 'iwashi' are synthesized according to the VCV-based speech synthesis scheme.

Following illustrative embodiments will be described in conjunction with a conventional speech synthesis scheme in which speech components such as CV (C and V are abbreviations for 'consonant' and 'vowel', respectively), VCV, CV/VC, or CV/VCV-chained waveforms are concatenated to synthesize a speech. Specifically, it is assumed that the following illustrative embodiments basically use VCV-chained waveforms as voice segments or phonetic components of speech as shown in FIG. 2, which shows how, for example, Japanese words 'inu' and 'iwashi' are synthesized according to the VCV-based speech synthesis scheme. In FIG. 2, The word 'inu' is synthesized by combining components or voice segments 101 through 103. The word 'iwashi' is synthesized by combining voice segments 104 through 107. The phonetic components 102, 105 and 106 are VCV components, the components 101 and 104 are ones for the beginning of a word, and the components 103 and 107 are ones for the ending of a word.

Figure 3:
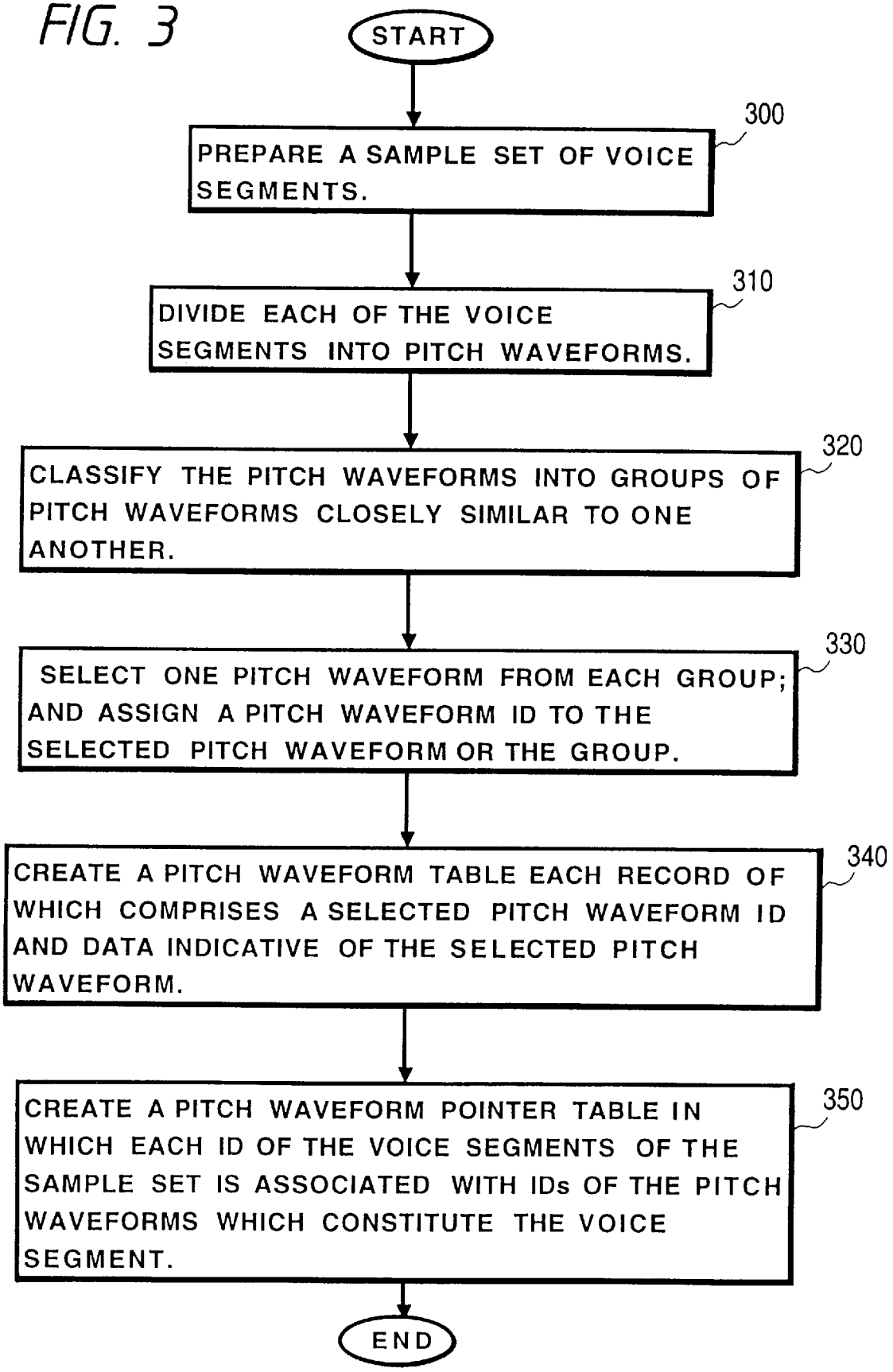
FIG. 3 is a flow chart illustrating a procedure of forming a voiced sound waveform database according to an illustrative embodiment of the invention.

FIG. 3 is a flow chart illustrating a procedure of forming a voiced sound waveform database according to an illustrative embodiment of the invention. In FIG. 3, a sample set of voice segments which seems to be necessary for the speech synthesis in Japanese are first prepared in step 300. For this, various words and speeches including such voice segments are actually spoken and stored in memory. The stored phonetic waveforms are divided into VCV-based voice segments, from which necessary voice segments are selected and gathered together into a not-shown voice segment table (i.e., the sample set of voice segments), each record of which comprises a voice segment ID and a corresponding voice segment waveform.

In step 310, each of the voice segment waveforms in the voice segment table (not shown) are further divided into pitch waveforms as shown again in FIG. 2. In this case, if each voice segment is subdivided into phonemes or phonetic units, the division unit is not small enough to easily find similar phonemes in the divided phonemes. If a VCV voice segment 'ama' is divided into 'a', 'm' and 'a' for example, then it is impossible to consider the sounds of the leading and succeeding vowels 'a' to be the same, which does not contribute a reduction in the size of the waveform data base. Because the leading vowel 'a' is similar to a single 'a', whereas the succeeding vowel 'a' is significantly affected by the following consonant 'm'. For this reason, in FIG. 2, the VCV voice segments 102 and 106 are subdivided into pitch waveforms 110 through 119 and 120 through 129, respectively. By doing this, it is possible to find a lot of closely similar pitch waveforms in the subdivided pitch waveforms. In case of FIG. 2, the pitch waveforms 110, 111 and 120 are very similar to one another.

In step 320, the subdivided pitch waveforms are classified into groups of pitch waveforms closely similar to one another. In step 330, a pitch waveform is selected as a representative from each group in such a manner as described later, and a pitch waveform ID is assigned to the selected pitch waveform or the group so as to use the selected pitch waveform instead of the other pitch waveforms of the group. In step 340, a pitch waveform table each record of which comprises a selected pitch waveform ID and data indicative of the selected pitch waveform is created, which completes a waveform database for the voiced sounds. Then, in step 350, a pitch waveform pointer table is created in which an ID of each of the voice segments of the sample set is associated with pitch waveform IDs of the groups to which the pitch waveforms constituting the voice segment belongs. A waveform database for the voiceless sounds may be formed in a conventional way.

As described above, sharing common (very similar) pitch waveforms among the voice segments permits the size of the waveform database to be drastically reduced.

FIG. 4A is a diagram showing an exemplary pitch waveform pointer table formed in step 350 of FIG. 3. In FIG. 4A, the pitch waveform pointer table 360 comprises the fields of a voice segment ID, pitch waveform IDs, and label information. The pitch waveform ID fields contain IDs of the pitch waveforms which constitute the voice segment identified by the pitch waveform ID. If there are pitch waveforms which belong to the same pitch waveform group in a certain record of the table 360, then the IDs for such pitch waveforms will be identical. The label information fields contain the number of pitch waveforms in the leading vowel of the voice segment, the number of pitch waveforms in the consonant, and the number of pitch waveforms in the succeeding vowel of the voice segment.

FIG. 4B is a diagram showing an exemplary arrangement of each record of the pitch waveform table created in step 340 of FIG. 3. Each record of the pitch waveform table comprises a pitch waveform ID and corresponding pitch waveform data as shown in FIG. 4B.

The way of classifying the pitch waveforms into groups of pitch waveforms closely similar to one another in step 320 of FIG. 3 will be described in the following. Specifically, the classification by a spectrum parameter, e.g., the power spectrum and the LPC (linear predictive coding) cepstrum of pitch waveform will be discussed.

Figure 5A:
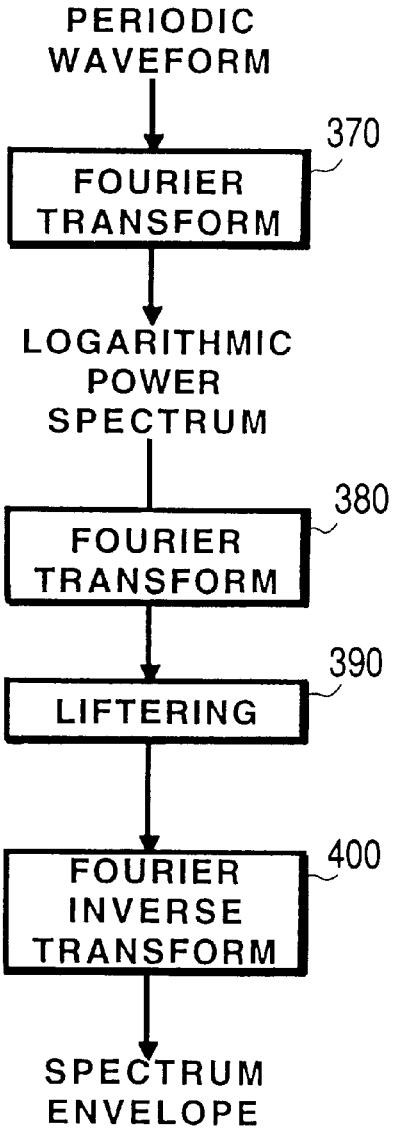
FIGS. 5A and 5B are flow charts showing an exemplary procedure of obtaining of spectrum envelopes for a periodic waveform and a pitch waveform, respectively.
Figure 5B:
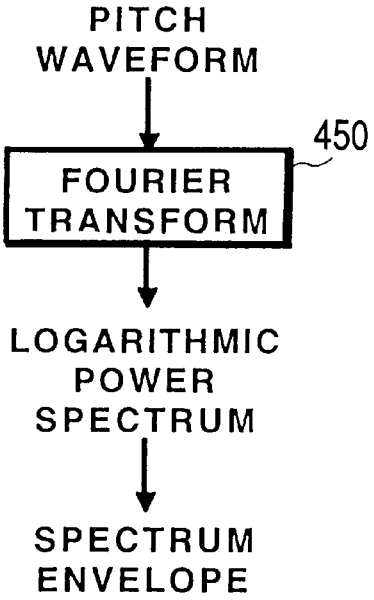

In order to obtain a spectrum envelope of a periodic waveform, a procedure as shown in FIG. 5A has to be followed. In FIG. 5A, a periodic waveform is subjected to a Fourier transform to yield a logarithmic power spectrum shown as 501 in FIG. 6 in step 370. The obtained spectrum is then subjected to another Fourier transform of step 380, a liftering of step 390 and a Fourier inverse transform of step 400 to finally yield a spectrum envelope shown as 502 in FIG. 6. On the other hand, in case of a pitch waveform, the spectrum envelope of the pitch waveform can be obtained by Fourier transforming the pitch waveform into a logarithmic power spectrum in step 450. Taking this into account, instead of analyzing a speech waveform through an analysis window of several tens milliseconds in size as has been done so far, a power spectrum is calculated after subdivision into pitch waveforms. A correct classification can be achieved with a small quantity of calculations by classifying the phonemes by using a power spectrum envelope as the classifying scale.

Figure 6:
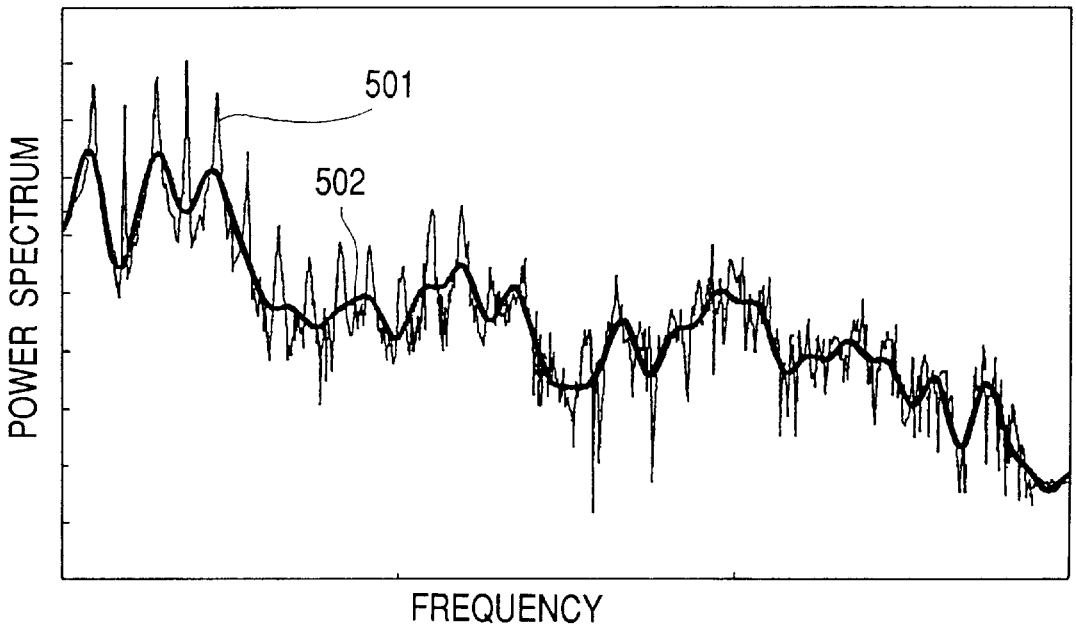
FIG. 6 is a graph showing a power spectrum of a periodic waveform.
Figure 7:
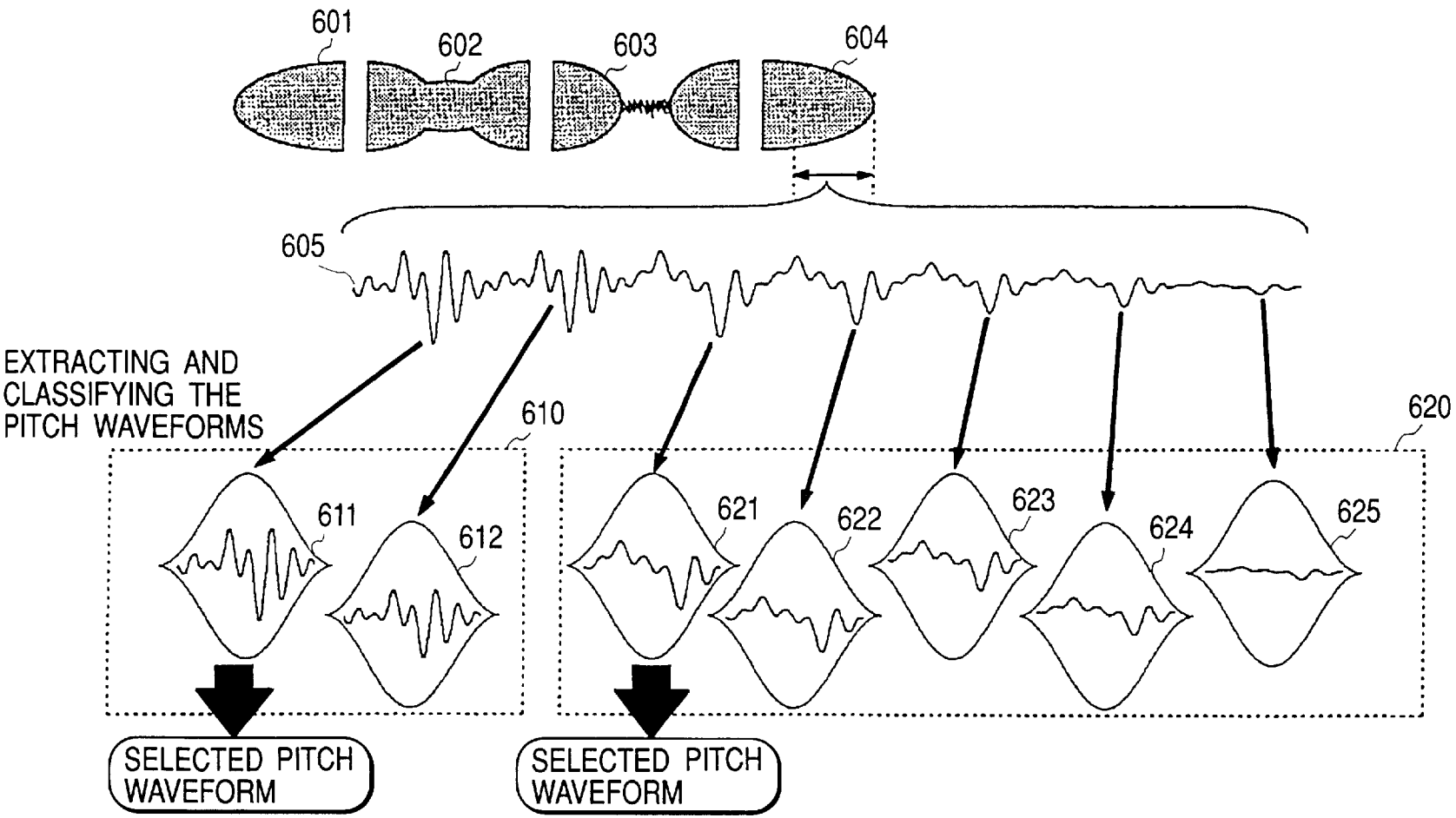
FIG. 7 is a diagram illustrating a first exemplary method of selecting a representative pitch waveform from the pitch waveforms of a classified group in step 330 of FIG. 3.

FIG. 7 is a diagram illustrating a first exemplary method of selecting a representative pitch waveform from the pitch waveforms of a classified group in step 330 of FIG. 3. In FIG. 6, the reference numerals 601 through 604 denote synthesis units or voice segments. The latter half of the voice segment 604 is shown further in detail in the form of a waveform 605, which is subdivided into pitch waveforms. The pitch waveforms cut from the waveform 605 are classified into two groups, i.e., a group 610 comprising pitch waveforms 611 and 612 and a group 620 comprising pitch waveforms 621 through 625 which are similar in power spectrum. The pitch waveform with a maximum amplitude, (611, 621), is preferably selected as a representative from each of the groups 610 and 520 so as to avoid a fall in the S/N ratio which is involved in a substitution of the selected pitch waveform for a larger pitch waveform such as 621. For this reason, the pitch waveform 611 is selected in the group 610 and the pitch waveform 621 is selected in the group 620. Selecting representative pitch waveforms in this way permits the overall S/N ratio of the waveform database to be improved. Since there are, naturally, pitch waveforms cut from different voice segments in a pitch waveform group, even if a voice segment of a low S/N ratio is recorded in the sample set preparing process, the pitch waveforms of the voice segment are probably substituted by pitch waveforms with higher S/N ratios which have been cut from other voice segments, which enables a formation of waveform database of a higher S/N ratio.

Figure 8:
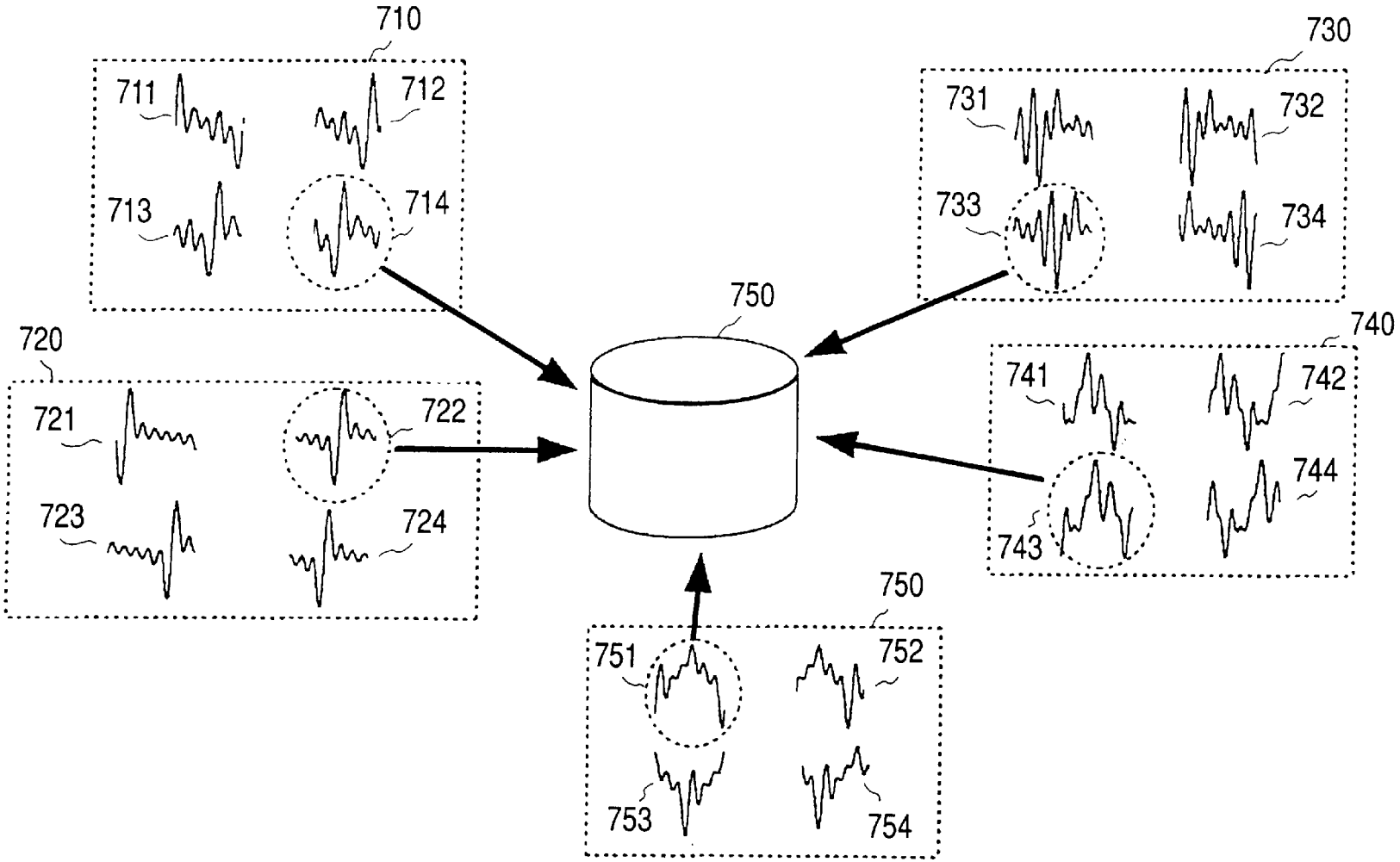
FIG. 8 is a diagram illustrating a second exemplary method of selecting a representative pitch waveform from the pitch waveforms of a classified group in step 330 of FIG. 3.

FIG. 8 is a diagram illustrating a second exemplary method of selecting a representative pitch waveform from the pitch waveforms of a pitch waveform group in step 330 of FIG. 3. In FIG. 8, the reference numerals 710, 720, 730, 740 and 750 are pitch waveform groups obtained through a classification by the phoneme. In this case, the selection of pitch waveforms from the groups is so achieved that the selected pitch waveforms have a similar phase characteristic. For example in FIG. 8, a pitch waveform in which the positive peak value lies in the center thereof is selected from each group. That is, the pitch waveforms 714, 722, 733, 743 and 751 are selected in the groups 710, 720, 730, 740 and 750, respectively. It should be noted that a further precise selection is possible by analyzing the phase characteristic of each pitch waveform by means of, e.g., a Fourier transform.

Selecting representative pitch waveforms in this way causes pitch waveforms with a similar phase characteristic to be combined even though the pitch waveforms are collected from different voice segment, which can avoid a degradation in the sound quality due to the difference in the phase characteristic.

In the above description, each voice segment has had only a single value and accordingly each pitch waveform had no pitch variation. This may be enough if a speech is synthesized only based on text data of the speech. However, if the speech synthesis is to be conducted based on not only text data but also pitch information of a speech to provide a more naturally synthesized speech, a waveform database as will be described below will be preferable.

Preferred Waveform Database

Figure 9:
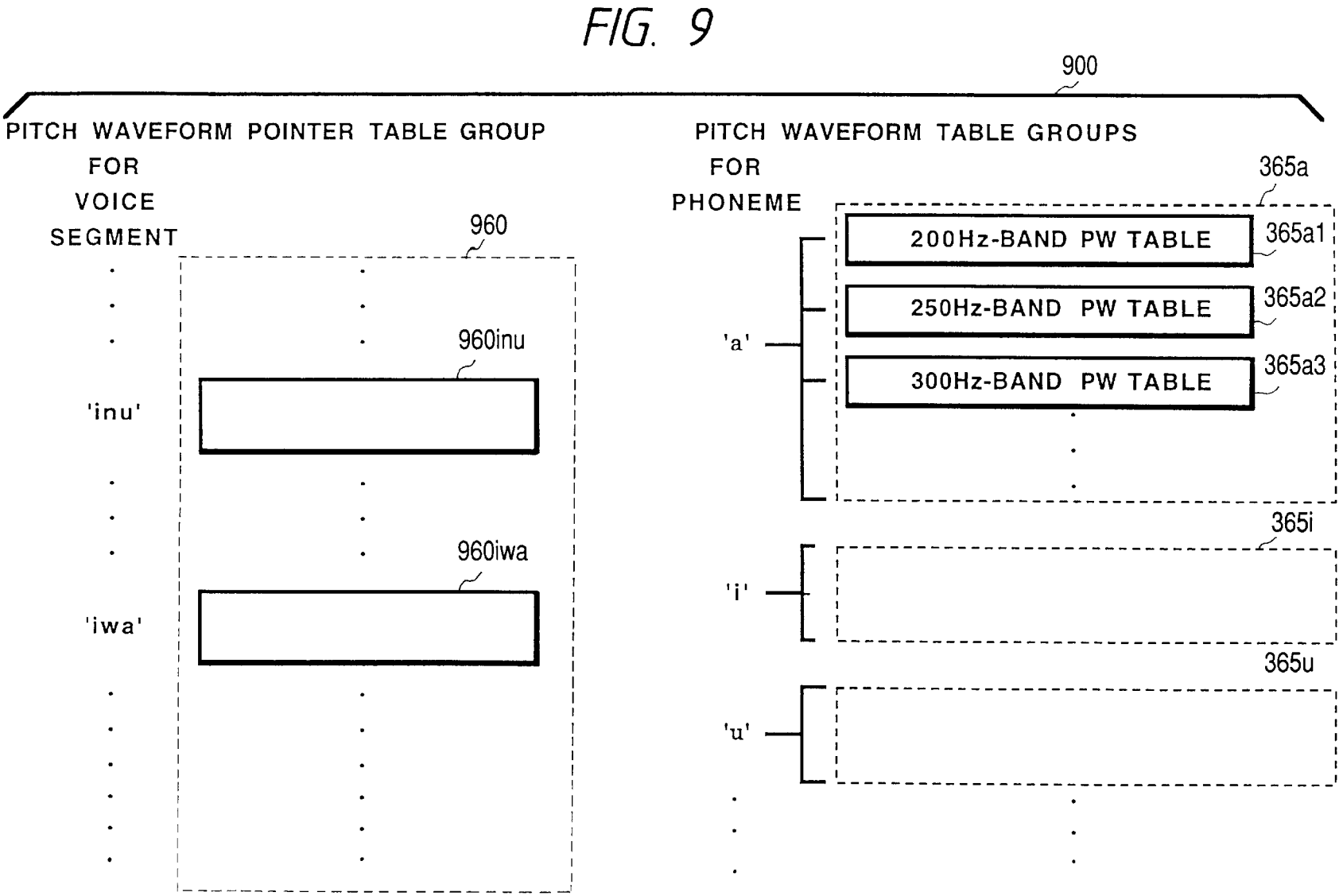
FIG. 9 is a diagram showing an arrangement of a waveform database, used in the speech synthesis system of FIG. 1, in accordance with the second illustrative embodiment of the invention.

FIG. 9 is a diagram showing an arrangement of a voiced sound waveform database in accordance with a preferred embodiment of the invention. In FIG. 9, the voiced sound waveform database 900 comprises a pitch waveform pointer table group 960 and pitch waveform table groups {365π|(π denotes the phonemes used in the language, i.e., π=a, i, u, e, o, k, s, . . . } classified by phoneme such as power spectrum. Each pitch waveform table group 365π, e.g., 365*a*, comprises pitch waveform tables 365*a*1, 365*a*2, 365*a*3, . . . 365*a*N for predetermined pitch (frequency) bands—200–250 Hz, 250–300 Hz, 300–350 Hz, . . . where N is the number of the predetermined pitch bands. Each pitch waveform table 365πα (α=1, 2, . . . ,N) has the same structure as that of the pitch waveform table 365 of FIG. 4B. ('α' is a pitch band number. For example α=1 indicates a band of 200–250 Hz, α=2 indicates a band of 250–300 Hz, and so on.) The classification or grouping by phoneme may be achieved in any form, e.g., by actually storing the pitch waveform tables 365π1 through 365πN of the same group in a associated folder or directory, or by using a table for associating phoneme 'π' and pitch band 'α' information with a corresponding pitch waveform table 365πα.

FIG. 10 shows an exemplary structure of a pitch waveform pointer table, e.g., 306inu (for a phoneme-chained pattern 'nu') shown in FIG. 9. For each phoneme-chained pattern, a pitch waveform pointer table is created. In FIG. 10, the pitch waveform pointer table 960inu is almost identical to the pitch waveform pointer table 360 of FIG. 4A except that the record ID has been changed from the phoneme-chained pattern (voice segment) ID to the pitch (frequency) band. Expressions such as 'i100', 'n100' and so on denote pitch waveform IDs.

In the voiced sound waveform database of FIGS. 4A and 4B, there has been only one voice segment for each phoneme-chained pattern. However, in the voiced sound waveform database 900 of FIGS. 9 and 10, there are four voice segments for each phoneme-chained pattern. For this reason, the phoneme-chained pattern and the voice segment have to be discriminated hereinafter. The ID of each phoneme-chained pattern is expressed as IDp. p=1, 2 . . . P, where P is the number of phoneme-chained patterns of a sample set (described later). Using the variable 'p', a pitch waveform pointer table for a phoneme-chained pattern IDp is hereinafter denoted by 960*p*.

There is a (horizontal) line of values which each indicates the elapsed times at the time of ending of the pitch waveforms in the column of the value. The pitch waveform IDs with a shading are IDs of either pitch waveforms which have been originated from a voice segment of the phoneme-chained pattern (IDp) of this pitch waveform pointer table 960*p* or pitch waveforms which are closely similar to those pitch waveforms and therefore have been cut from other voice segments. Accordingly, one shaded pitch waveform ID never fails to exist in a column. However, the other pitch waveform ID fields are not guaranteed the existence of a pitch waveform ID, i.e., there may not be IDs in some of the other pitch waveform ID fields. If a vacant pitch waveform ID field is to be referred to, one of the adjacent fields with IDs is preferably referred to. There are also label information fields in each pitch waveform pointer table 960*p*. The label information shown in FIG. 10 is the simplest example and has the same structure as that of FIG. 4A.

FIG. 11 is a flow chart illustrating a procedure of forming the voiced sound waveform database 900 of FIG. 9. In FIG. 11, a sample set of voice segments is so prepared that each phoneme-chained pattern IDp is included in each of predetermined pitch bands in step 800. In step 810, each voice segment is divided into pitch waveforms. In step 820, the pitch waveforms are classified by the phoneme into phoneme groups, each of which is further classified into pitch groups of predetermined pitch bands. In step 830, the pitch waveforms of each pitch group are classified into groups of pitch waveforms closely similar to one another. In step 840, a pitch waveform is selected from each group, and an ID is assigned to the selected pitch waveform (or the group). In step 850, a pitch waveform table of a selected waveform group of each pitch band is created. Then in step 860, for each phoneme-chained pattern, a pitch waveform pointer table is created in which each record at least comprises pitch band data and IDs of pitch waveforms which constitute the voice segment (the pattern) of the pitch band defined by the pitch band data.

Voiceless Sound Waveform Table

For each phoneme-chained (e.g., VCV-chained) voice segment including a voiceless sound (consonant), if the voiceless sound waveform is stored in a waveform table, this causes the table (or database) to be redundant. This can be avoided in the same manner as in case of the voiced sound.

Figure 12:
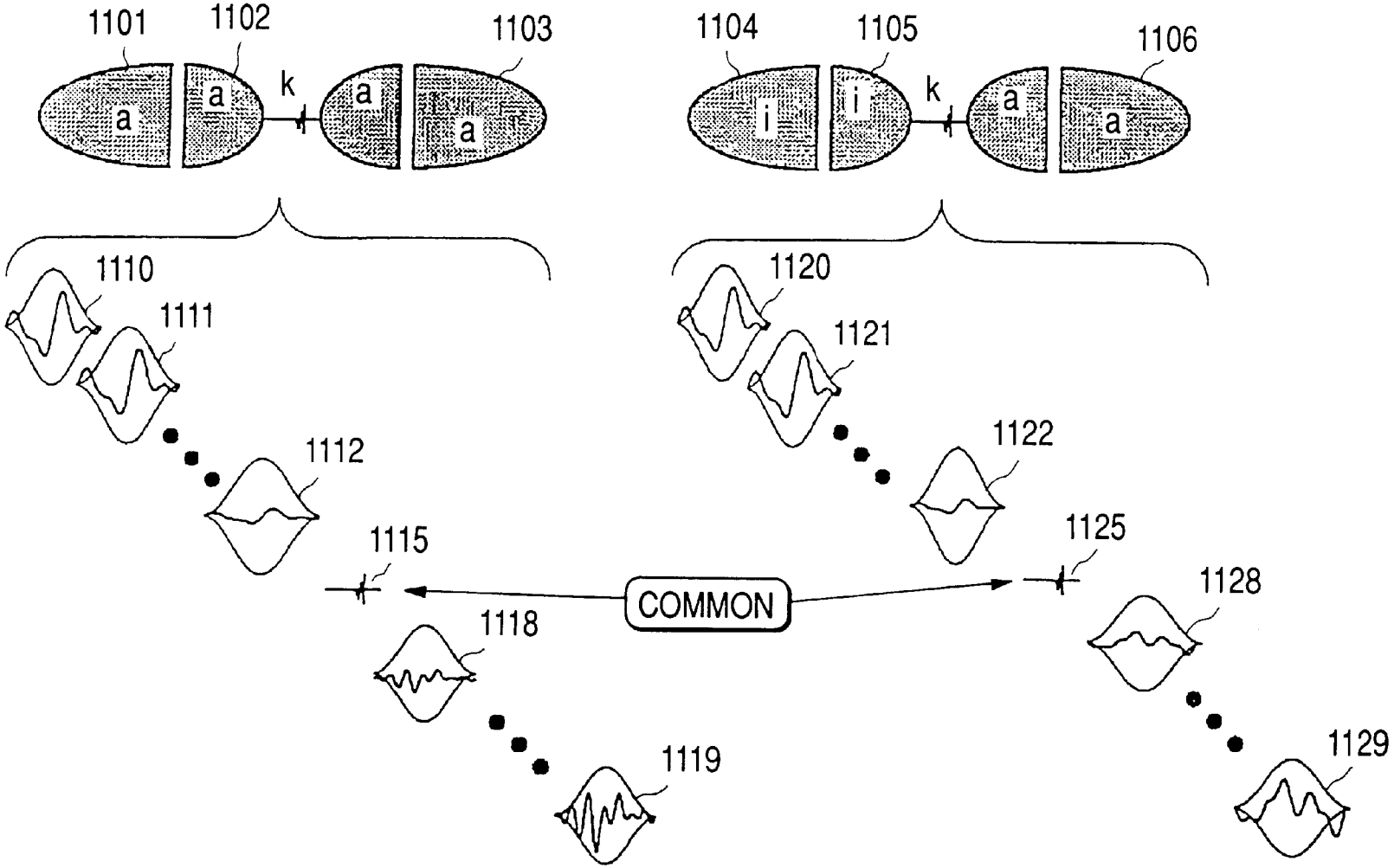
FIG. 12 is a diagram showing how different voice segments share a common voiceless sound.

FIG. 12 is a diagram showing how different voice segments share a common voiceless sound. In FIG. 12, like the case of voice segments comprising only voiced sounds, voice segment 'aka' 1102 is divided into pitch waveforms 1110, . . . , 1112, a voiceless sound 1115 and pitch waveforms 1118, . . . , 1119, and voice segment 'ika' 1105 is divided into pitch waveforms 1120, . . . , 1122, a voiceless sound 1125 and pitch waveforms 1128, . . . , 1129. In this case, the two voice segments 'aka' 1102 and 'ika' 1105 share voiceless consonants 1115 and 1125.

Figure 13:
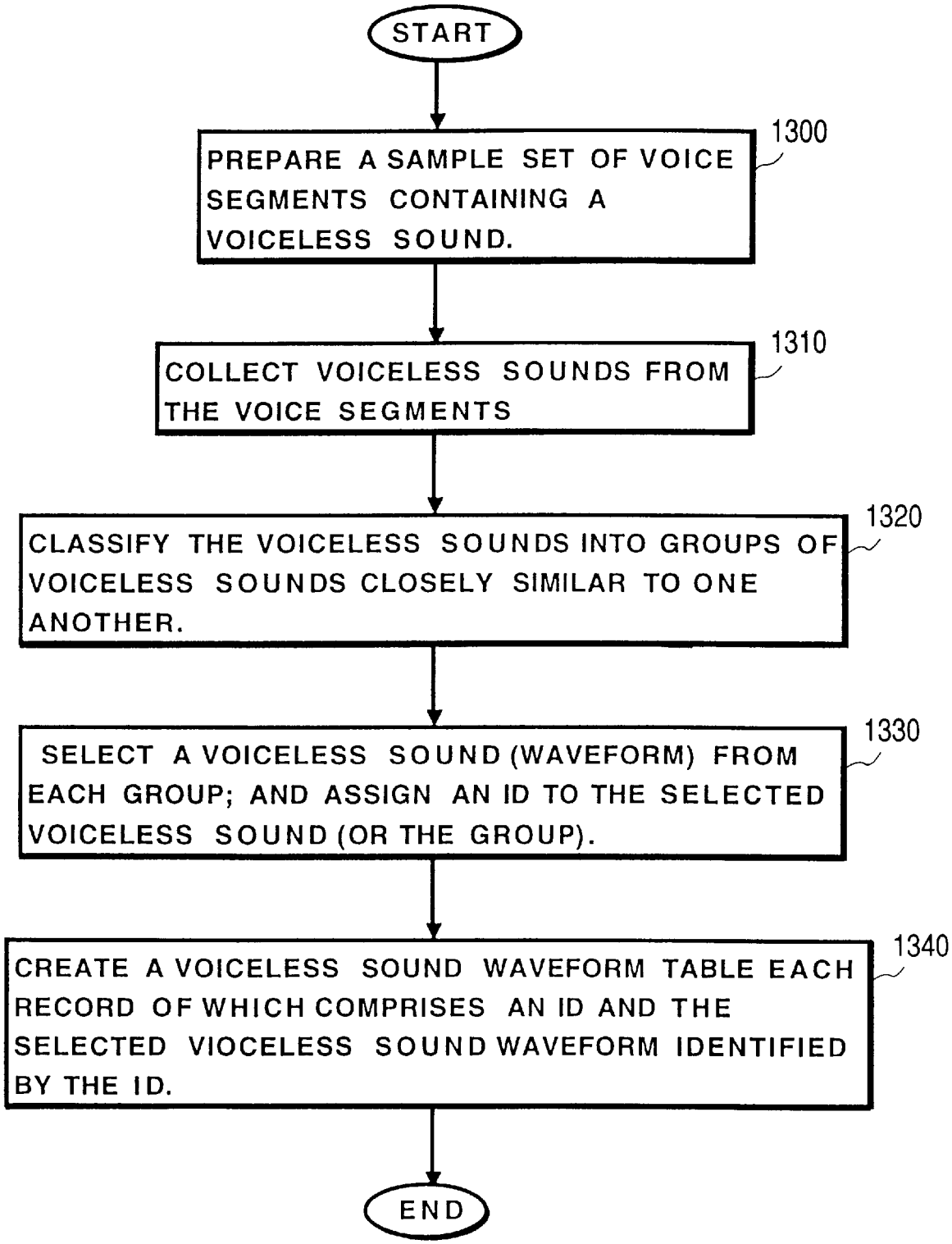
FIG. 13 is a flow chart illustrating a procedure of forming a voiceless sound waveform table according to the illustrative embodiment of the invention.

FIG. 13 is a flow chart illustrating a procedure of forming a voiceless sound waveform table according to the illustrative embodiment of the invention. In FIG. 13, a sample set of voice segments containing a voiceless sound is prepared in step 1300. In step 1310, voiceless sounds are collected from the voice segments. In step 1320, the voiceless sounds are classified into groups of voiceless sounds closely similar to one another. In step 1330, a voiceless sound (waveform) is selected from each group, and an ID is assigned to the selected voiceless sound (or the group). In step 1340, there is created a voiceless sound waveform table each record of which comprises one of the assigned IDs and the selected voiceless sound waveform identified by the ID.

Operation of the Speech Synthesis System

Figure 14:
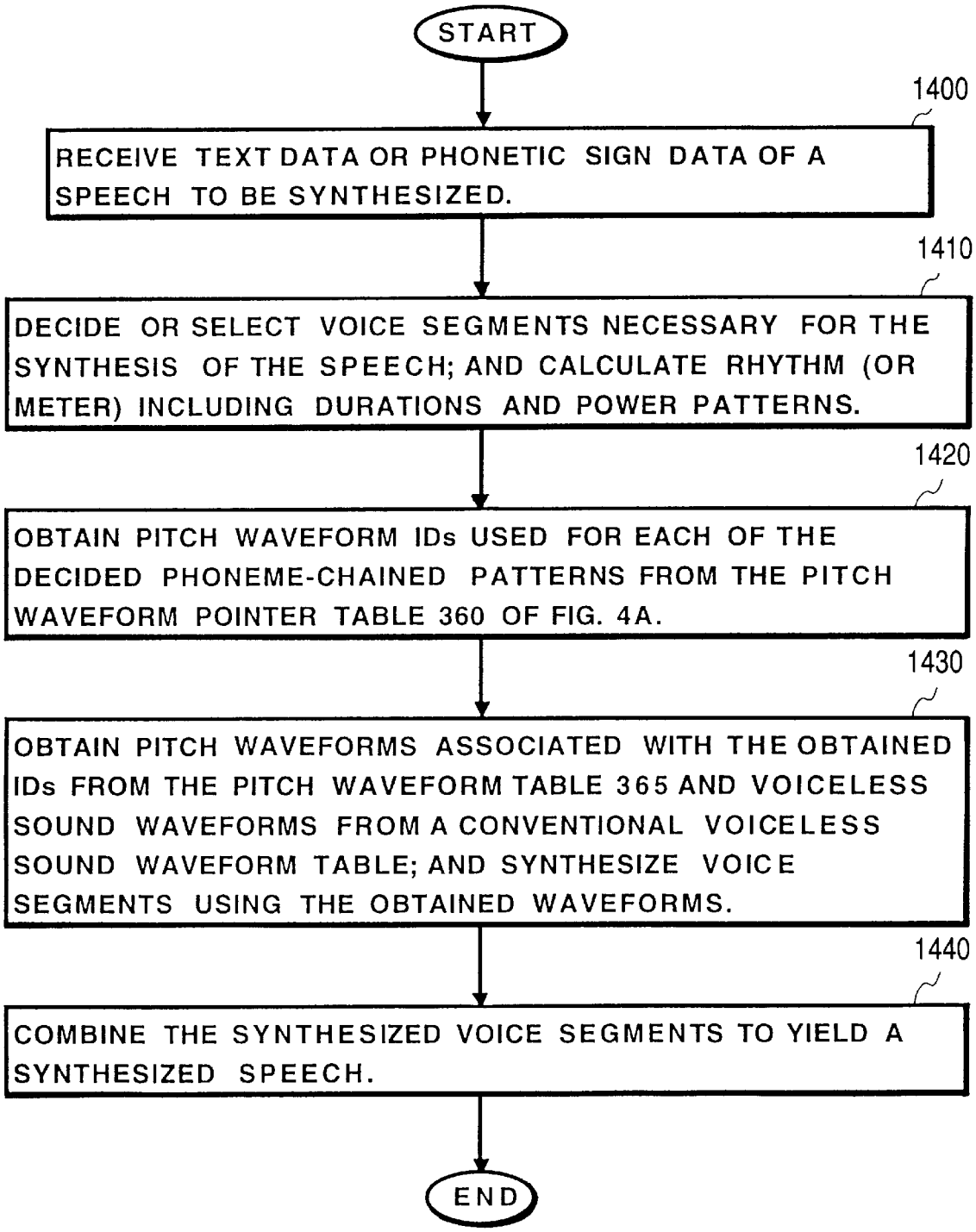
FIG. 14 is a flow chart showing an exemplary flow of a speech synthesis program using the voiced sound waveform database of FIG.4.

FIG. 14 is a flow chart showing an exemplary flow of a speech synthesis program using the voiced sound waveform database of FIG. 4. On entering the program, the controller 10 receives text data of a speech to be synthesized in step 1400. In step 1410, the controller 10 decides phoneme-chained patterns of voice segments necessary for the synthesis of the speech; and calculates rhythm (or meter) including durations and power patterns. In step 1420, the controller 10 obtains pitch waveform IDs used for each of the decided phoneme-chained patterns from the pitch waveform pointer table 360 of FIG. 4A. In step 1430, the controller 10 obtains pitch waveforms associated with the obtained IDs from the pitch waveform table 365 and voiceless sound waveforms from a conventional voiceless sound waveform table, and synthesizes voice segments using the obtained waveforms. Then in step 1440, the controller 10 combines the synthesized voice segments to yield a synthesized speech, and ends the program.

Figure 15:
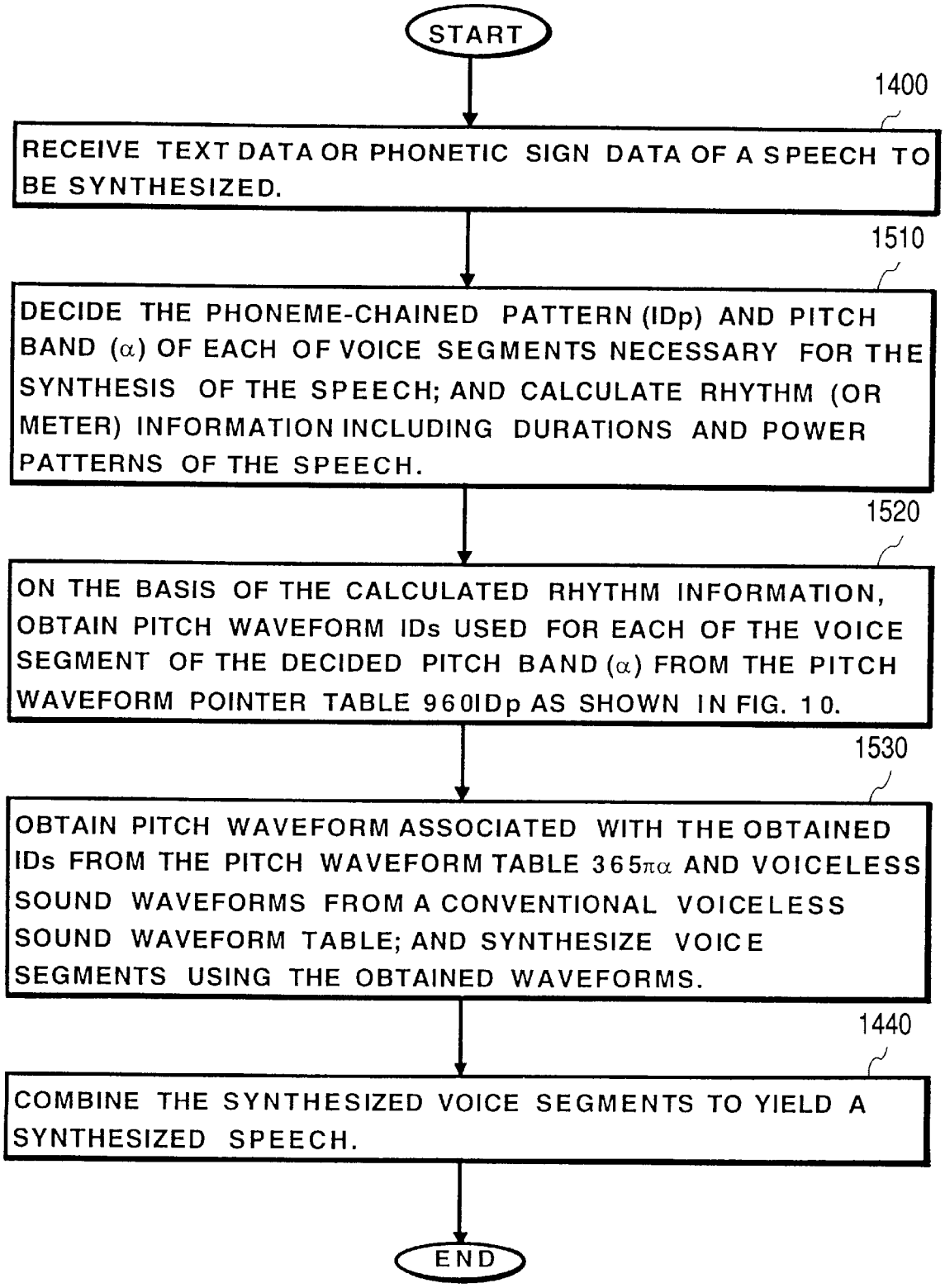
FIG. 15 is a flow chart showing an exemplary flow of a speech synthesis program using the voiced sound waveform database of FIGS. 9 and 10.

FIG. 15 is a flow chart showing an exemplary flow of a speech synthesis program using the voiced sound waveform database of FIGS. 9 and 10. The steps 1400 and 1440 of FIG. 15 are identical to those of FIG. 14. Accordingly, only the steps 1510 through 1530 will be described. In response to a reception of text data or phonetic sign data, the controller 10 decides the phoneme-chained pattern (IDp) and pitch band ($\alpha$) of each of voice segments necessary for the synthesis of the speech, and calculates rhythm (or meter) information including durations and power patterns of the speech in step 1510. On the basis of the calculated rhythm information, the controller 10 obtains pitch waveform IDs used for each of the voice segments of the decided pitch band ($\alpha$) from the pitch waveform pointer table 960idp as shown in FIG. 10 in step 1520. In step 1530, the controller 10 obtains pitch waveforms associated with the obtained ids from the pitch waveform table 365$\pi\alpha$ and voiceless sound waveforms from a conventional voiceless sound waveform table, and synthesizes voice segments using the obtained waveforms. Then in step 1440, the controller 10 combines the synthesized voice segments to yield a synthesized speech, and ends the program.

Many widely different embodiments of the present invention may be constructed without departing from the spirit and scope of the present invention. It should be understood that the present invention is not limited to the specific embodiments described in the specification, except as defined in the appended claims.

What is claimed is:

1. A database for use in a system for synthesizing a speech by concatenating a subset of a plurality of predetermined voice segments, the database comprising:

a first table for associating each of said plurality of predetermined voice segments with pitch waveform IDs (identifiers) of pitch waveforms which, when combined in the listed order of said pitch waveform IDs, constitute a waveform of said each of said predetermined voice segments; and a second table for associating each pitch waveform ID with pitch waveform data identified by said each pitch waveform ID, wherein said second table is obtained by dividing each of said plurality of predetermined voice segments into pitch waveforms; classifying all of the pitch waveforms into groups of very similar pitch waveforms; and selecting one of said very similar pitch waveforms in each of said groups for said second table and wherein said very similar pitch waveforms in each respective one of said groups in said first table each have a same respective pitch waveform ID.

2. A database as defined in claim 1, wherein all of the pitch waveform data in the database have a same phase characteristic.

3. A database for use in a system for synthesizing a speech by concatenating some of a plurality of predetermined voice segments each defined by a phoneme-chained pattern and a pitch band, the database comprising:

first table means for associating each of said plurality of predetermined voice segments which is identified by one of predetermined pitch band IDs and one of predetermined phoneme-chained pattern IDs with pitch waveform IDs of pitch waveforms which, when combined in the listed order of said pitch waveform IDs, constitute a waveform of said each of said predetermined voice segments; and second table means for permitting each of said pitch waveform IDs and said one of predetermined pitch band IDs to be used to find pitch waveform data associated with said each of said pitch waveform IDs, wherein said second table means is obtained by dividing each of said plurality of predetermined voice segments into pitch waveforms; classifying all of the pitch waveforms by phoneme and pitch band into groups of very similar pitch waveforms; and selecting one of said very similar pitch waveforms in each of said groups for said second table means and wherein said very similar pitch waveforms in each respective one of said groups in said first table means each have a same respective pitch waveform ID.

4. A database as defined in claim 3, wherein said first table means comprises tables by phoneme-chained patterns, each record of each of said table comprising one of said predetermined pitch band IDs and pitch waveform IDs of pitch waveforms which, when combined in the listed order of said pitch waveform IDs, constitute a waveform characterized by a phoneme-chained pattern associated with said each of said table and by said one of said predetermined pitch band IDs.

5. A database as defined in claim 3, wherein:

said second table means comprises table groups by phonemes constituting phoneme-chained patterns identified by phoneme-chained pattern IDs;

each of said table groups comprises tables identified by said predetermined pitch band IDs; and each record of each of said tables comprises one of pitch waveform IDs of pitch waveforms of a phoneme-chained pattern and a pitch band associated with said each of said tables and a pitch waveform associated with said one of said pitch waveform IDs.

6. A database as defined in claim 3, wherein all of the pitch waveform data in the database have a same phase characteristic.

7. A database for use in a system for synthesizing a speech by concatenating some of predetermined voice segments, the database including:

a first table for associating each of said predetermined voice segments with waveform IDs of pitch and voiceless sound waveforms which, when combined in the listed order of said waveform IDs, constitute a waveform of said each of said predetermined voice segments; and a second table for associating each voiceless sound waveform ID with voiceless sound waveform data identified by said each voiceless sound waveform ID, wherein voice segments containing closely similar voiceless sound waveforms have an identical waveform ID assigned to said closely similar voiceless sound waveforms in said first table, and wherein said second table is obtained by collecting said voiceless sound waveforms from said predetermined voice segments; classifying all of said voiceless sound waveforms into groups of closely similar voiceless sound waveforms; and selecting one of said closely similar voiceless sound waveforms in each of said groups for said second table.

8. A method of making a database for use in a system for synthesizing a speech by concatenating predetermined voice segments, the method comprising the steps of:

dividing each of said predetermined voice segments into pitch waveforms;

classifying all of the pitch waveforms into groups of very similar pitch waveforms;

selecting one of said very similar pitch waveforms in each of said groups;

assigning a pitch waveform ID to said selected pitch waveform of each of said groups;

creating a first table which, for each of said groups, has a record comprising said pitch waveform ID and data of said selected pitch waveform; and creating a second table whose record IDs comprise the IDs of said predetermined voice segments, each record of said second table containing pitch waveform IDs which, when combined in the listed order of said pitch waveform IDs, constitutes a waveform identified by said record ID.

9. A method as defined in claim 8, wherein said step of classifying all of the pitch waveforms comprises the step of classifying all of the pitch waveforms by spectrum parameter of each of said pitch waveforms.

10. A method as defined in claim 8, wherein said step of selecting one of said very similar pitch waveforms in each of said groups comprises the step of selecting a pitch waveform of the largest power in each of said groups.

11. A method as defined in claim 8, wherein said step of selecting one of said very similar pitch waveforms in each of said groups is achieved such that all of the selected pitch waveforms have the same phase characteristic.

12. A method as defined in claim 8, wherein said step of creating a first table comprises using the data of only the respective selected pitch waveforms in the records for the respective groups, thereby excluding from the database pitch waveforms very similar to the selected pitch waveforms and grouped therewith.

13. A method as defined in claim 12, wherein said step of assigning a pitch waveform ID comprises assigning said pitch waveform ID only to the one selected pitch waveform of each of said groups.

14. A system for synthesizing a speech by concatenating some of predetermined voice segments, comprising:

means for determining IDs of necessary ones of said predetermined voice segments necessary for said speech;

means for associating each of said determined ID with pitch waveform IDs the pitch waveforms of which, when combined in the listed order of said pitch waveform IDs, constitute a waveform identified by said each of said determined IDs;

means for obtaining pitch waveforms associated with said pitch waveform IDs, including a pitch waveform table created by dividing each of said predetermined voice segments into pitch waveforms; classifying all of the pitch waveforms into groups of very similar pitch waveforms; and selecting one of said very similar pitch waveforms in each of said groups;

means for combining said obtained pitch waveforms to form said necessary voice segments; and means for combining said necessary voice segments to yield said speech.

15. A system for synthesizing a speech by concatenating some of predetermined voice segments each defined by a phoneme-chained pattern and a pitch band, comprising:

means for determining an IDs and a pitch band of each of necessary ones of said predetermined voice segments necessary for said speech, means for associating a combination of said determined ID and said determined pitch band with pitch waveform IDs the pitch waveforms of which, when combined in the listed order of said pitch waveform IDs, constitute a waveform identified by said determined ID and said determined pitch band;

means for obtaining pitch waveforms associated with said pitch waveform IDs and said determined pitch band, including a set of pitch waveforms obtained by dividing each of said predetermined voice segments into pitch waveforms; classifying all of said divided pitch waveforms by phoneme and pitch band into groups of very similar pitch waveforms; and selecting one of said very similar pitch waveforms in each of said groups for said set;

means for combining said obtained pitch waveforms to form said necessary voice segments; and means for combining said necessary voice segments to yield said speech.

* * * * *